US006103299A

United States Patent [19]

Shimamune et al.

[11] Patent Number: 6,103,299

[45] Date of Patent: Aug. 15, 2000

[54] METHOD FOR PREPARING AN ELECTRODE FOR ELECTROLYTIC PROCESSES

[75] Inventors: Takayuki Shimamune; Yasuo Nakajima, both of Tokyo, Japan

[73] Assignee: Permelec Electrode Limited, Kanagawa, Japan

[21] Appl. No.: 08/109,597

[22] Filed: Aug. 20, 1993

Related U.S. Application Data

[62] Division of application No. 07/972,630, Nov. 6, 1992, Pat. No. 5,354,444.

[30] Foreign Application Priority Data

Nov. 28, 1991 [JP] Japan ..... 3-338011

[51] Int. Cl.[7] ..... B05D 5/12

[52] U.S. Cl. ..... 427/126.3; 427/190; 427/202; 427/205; 427/226

[58] Field of Search ..... 427/74, 125, 126.3, 427/190, 202, 205, 226; 204/290 R, 290 F

[56] References Cited

U.S. PATENT DOCUMENTS

| | | | |
|---|---|---|---|
| 4,029,566 | 6/1977 | Brandmair et al. | 204/291 |
| 4,468,416 | 8/1984 | Asano et al. | 427/126.3 |
| 4,481,097 | 11/1984 | Asano et al. | 204/290 F |
| 4,502,936 | 3/1985 | Hayfield | 204/291 |

FOREIGN PATENT DOCUMENTS

| | | |
|---|---|---|
| 0052986 | 6/1982 | European Pat. Off. . |
| 0140287 | 5/1985 | European Pat. Off. . |
| 0344378 | 12/1989 | European Pat. Off. . |
| 2213101 | 8/1974 | France . |
| 2532331 | 3/1984 | France . |

*Primary Examiner*—Kathryn Gorgos
*Attorney, Agent, or Firm*—Sughrue, Mion, Zinn, Macpeak & Seas, PLLC

[57] ABSTRACT

An electrolytic electrode substrate comprises an electrically conductive substrate and, formed on the surface of the electrically conductive substrate, an oxide layer having a thickness of from 10 to 200 $\mu$m, wherein the oxide in the oxide layer comprises a non-stoichiometric composition containing oxygen and at least one metal selected from the group consisting of titanium, tantalum, and niobium. An advantage of the electrode substrate is that it is stable when used in electrolytic processes involving a reversal of current flow. Further, the electrode substrate is stable in the presence of corrosive substances such as a fluorine.

3 Claims, No Drawings

METHOD FOR PREPARING AN ELECTRODE FOR ELECTROLYTIC PROCESSES

This is a divisional of application Ser. No. 07/972,630 filed Nov. 6, 1992, now U.S. Pat. No. 5,354,444.

FIELD OF THE INVENTION

The present invention relates to an electrolytic electrode substrate having high durability, an electrolytic electrode employing the substrate, and processes for producing them. More particularly, this invention relates to an electrolytic electrode substrate and an electrolytic electrode which suffer almost no deterioration even when used in baths containing a corrosive substance such as fluorine or when used in electrolysis involving a reversal of current flow, and to processes for producing the substrate and the electrode.

BACKGROUND OF THE INVENTION

Industrial electrolysis, particularly electrolysis of mainly inorganic acids, is being conducted in an extremely wide range of fields such as electrolytic refining of metals, electroplating, electrolytic syntheses of organic substances and inorganic substances, etc. Although lead or lead alloy electrodes, platinum-plated titanium electrodes, carbon electrodes, and the like have been proposed as electrodes, especially anodes, for use in such electrolytic processes, each of these electrodes has certain drawbacks, and hence, none of them have come into practical use in a wide range of electrolytic applications. For example, lead electrodes having on the surface thereof a layer of lead dioxide which is relatively stable and has good electrical conductivity, have the drawbacks that even this lead dioxide dissolves away under ordinary electrolytic conditions at a rate of several milligrams per ampere-hour and the electrode shows a large overvoltage. Platinum-plated titanium electrodes have a short life for their high price. Further, carbon electrodes have the drawbacks that where the anodic reaction is an oxygen-evolving reaction, the carbon electrode reacts with the evolved oxygen to consume itself as carbon dioxide, and the electrode has poor electrical conductivity.

In order to eliminate these drawbacks of conventional electrodes, a dimensionally stable electrode (DSE) has been proposed and is being used extensively.

The DSE functions as a long-life electrode having exceptionally good chemical stability so long as it employs a valve metal such as titanium as the substrate and is used as an anode, because the surface of the substrate is passivated. However, when the DSE is used as a cathode and undergoes a cathodic polarization, the substrate turns into a hydride through reaction with evolved hydrogen and, as a result, the substrate itself becomes brittle or the surface covering peels off due to corrosion of the substrate, leading to a considerably shortened electrode life. This is a serious drawback when the DSE is used in electrolytic processes in which the current flow is reversed.

In addition, the DSE has another problem in that if it is used in an electrolyte solution containing fluorine or fluoride ions even in a slight amount, the substrate comprising titanium or a titanium alloy suffers corrosion, shortening the electrode life considerably even when the electrode is used as an anode. For example, if the DSE is used in an electrolyte solution containing fluorine in an amount as slight as about from 3 to 5 ppm, the electrode life is, at the most, one-tenth the ordinary life of the electrode. Thus, this problem constitutes a serious obstacle to possible applications of the DSE to various electrolytic fields other than soda-producing electrolysis for which the electrode can be used completely satisfactorily.

SUMMARY OF THE INVENTION

An object of the present invention is to provide an electrode substrate which, even when used in a cathodically polarized state in electrolytic processes involving a reversal of current flow or when used in electrolyte solutions containing a corrosive substance such as fluorine, undergoes almost no corrosion or other undesirable changes and can be used over a long period of time under stable electrolytic conditions, thereby eliminating the above-described drawbacks of the conventional electrodes, particularly the DSE.

Another object of the present invention is to provide an electrode using the above-described substrate.

Still another object of the present invention is to provide processes for producing the above-described substrate and electrode.

The present invention provides an electrolytic electrode substrate comprising an electrically conductive substrate and an oxide layer formed directly on the surface of the electrically conductive substrate or on the surface of an intermediate binder layer. The oxide layer has a thickness of from 10 to 200 $\mu$m and the oxide comprises a non-stoichiometric composition containing oxygen and at least one metal selected from the group consisting of titanium, tantalum, and niobium.

The present invention further provides an electrolytic electrode comprising the electrode substrate described above, an intermediate thin layer formed on the electrode substrate and containing titanium, tantalum, and platinum, and an electrode active material layer covering the intermediate thin layer.

Processes for producing the electrolytic electrode substrate and electrolytic electrode are also provided by the present invention.

DETAILED DESCRIPTION OF THE INVENTION

A characteristic feature of the present invention resides in that the electrode substrate which is based on an electrically conductive substrate has an oxide layer having a non-stoichiometric composition formed on the electrically conductive substrate, thereby taking advantage of the resistance characteristics of the oxide layer similar to those of ceramics and attaining improved electrical conductivity due to the non-stoichiometric composition and, hence, providing a novel electrolytic electrode which has sufficient resistance to fluorine or its compounds and to electrolytic processes involving a reversal of current flow and which has relatively high electrical conductivity.

It should be noted that substantially none of the non-noble metals conventionally used as electrode substrates, such as valve metals, iron-group elements, and alloys thereof, e.g., stainless steel, are stable to both cathodic and anodic polarizations. Although certain ceramics are stable to both cathodic and anodic polarizations and have a certain degree of electrical conductivity, even such ceramics have not been suitable for use in industrial electrolytic electrodes to which a large quantity of electric current will be applied, because these ceramics have relatively high electrical resistance.

In the present invention, an oxide layer having properties similar to those of the ceramics is formed on an electrically conductive substrate and the resulting structure is used as an electrode substrate. Although the electrically conductive substrate, when an electrode using this substrate is actually used in electrolysis, does not come into direct contact with the electrolyte solution, there is the possibility that during the continuous use of the electrode, the oxide layer may develop minute through-holes and the electrolyte solution may come into contact with the electrically conductive substrate. It is, therefore, preferable that the electrically conductive substrate be made of a material having resistance to conventional electrolyte solutions. Examples of such materials include titanium, titanium alloys, nickel, and stainless steel.

The oxide layer formed on the electrically conductive substrate is a dense oxide layer containing at least one of titanium, tantalum, and niobium. This oxide layer may be formed directly on the electrically conductive substrate by, for example, flame spraying. However, there are cases in which the oxide layer has insufficient adhesion to the electrically conductive substrate if the metal contained in the oxide layer is different from the metal contained in or constituting the electrically conductive substrate, causing a peeling problem and other problems during long-term use. Such problems can be avoided by forming a binder layer between the electrically conductive substrate and the oxide layer. It is desirable that in order to enhance the binding power, the binder layer comprise a mixed oxide containing at least one of the metals contained in or constituting the substrate and at least one of the metals contained in the oxide layer. For example, where an electrically conductive substrate made of titanium is used and an oxide layer comprising tantalum oxide is formed, a binder layer comprising a mixed oxide of titanium and tantalum may be formed. This binder layer desirably is formed by a thermal decomposition method as follows. That is, an electrically conductive substrate the surface of which has been cleaned and then activated by acid washing is coated with hydrochloric acid containing titanium and tantalum, and the coating is baked at a temperature of from 450 to 650° C. for from 5 to 15 minutes. This procedure is repeated from 2 to 5 times, to thereby form a binder layer strongly bonded and united to the electrically conductive substrate. The thickness of the binder layer is not particularly limited, but the thickness of from about 0.1 to 1 $\mu$m is preferred. In the case of using a stainless-steel substrate, a binder layer comprising a mixed oxide of iron and tantalum, for example, may be formed by coating the substrate with hydrochloric acid containing the two elements or with an alcohol solution of chlorides of the two elements and baking the coating at 500 to 750° C. It is desirable that the iron compound for use in this thermal decomposition method is not iron chloride but iron nitrate, because iron chloride does not always show sufficient dispersibility, and hence, care should be taken in applying a coating fluid containing iron chloride. The calcination temperature for coatings containing iron is slightly higher than that for coatings containing titanium, and is preferably from about 500 to 700° C. As a material for forming a mixed oxide to constitute the binder layer, either niobium or a mixture of tantalum and niobium may be used in place of tantalum. In this case, however, especial care should be taken in conducting calcination because niobium is subject to oxidation.

Directly on the surface of the electrically conductive substrate or on the binder layer formed on an electrically conductive substrate, an oxide layer containing at least one of titanium, tantalum, and niobium is formed which substantially constitutes the outermost layer of the electrode substrate. This oxide layer should have electrical conductivity and corer the electrically conductive substrate or the binder layer substantially completely. Any method may be used for forming the oxide layer without particular limitation as long as the oxide layer formed has a non-stoichiometric composition, i.e., a composition represented by the formula $RO_{2-x}$ wherein R is a metallic element and $0<x<1$, preferably $0.1<x<0.5$. It is, however, desirable that the oxide layer be formed by flame spraying. In this method, coating material particles containing particles of an oxide of at least one of titanium, tantalum, and niobium, e.g., particles of titanium oxide and tantalum oxide and a small proportion (preferably 2 to 10 mol % (Ti basis)) of titanium sponge, are mixed together with or without pulverization and then sintered, and the thus-obtained sintered mass is flame-sprayed over the surface of an electrically conductive substrate by means of plasma spray coating to form an oxide layer. As the titanium oxide, tantalum oxide, and niobium oxide for use in flame spraying, a purified rutile ore, tantalite ore, and columbite ore may, respectively, be used as is.

When flame spraying is used to form an oxide layer, the oxide layer obtained has a non-stoichiometric composition and comprises a mixed oxide having electrical conductivity. This may be due to the high temperature during the flame spraying. Normally, the oxide layer formed by flame spraying shows strong adhesion to the electrically conductive substrate or binder layer. If required, however, the substrate on which an oxide layer has been formed may be reheated to 500 to 1,000° C. to improve the adhesion of the oxide layer.

The thickness of the oxide layer formed by flame spraying is preferably from 10 to 200 $\mu$m and more preferably from 50 to 100 $\mu$m. If the thickness of the oxide layer is below 10 $\mu$m, the oxide layer inevitably develops through-holes. If the thickness thereof exceeds 200 $\mu$m, peeling of the oxide layer is apt to occur because of its too large thickness and furthermore the oxide layer, which has an electrical conductivity of from $10^{-2}$ to $10^{-3}$ $\Omega$cm, causes a large ohmic loss at high current densities. In most cases, a large ohmic loss tends to result in a decrease in electrode life due to local heat generation.

Methods for forming the oxide layer are not limited to flame spraying. For example, a method may be used in which a sintered oxide mass prepared beforehand is dispersed in an aqueous solution containing titanium, tantalum, and/or niobium as coating-ingredient metals, and the sintered oxide is then coated on an electrically conductive substrate and baked. This method also can form an oxide layer having a non-stoichiometric composition.

Since the oxide layer has properties similar to those of ceramics, it is stable in the presence of fluorine and fluorine compounds which may come into electrolyte solutions and is also stable under electrolysis involving a reversal of current flow. Further, since the oxide layer is made of an oxide which usually has rutile-type lattices and a non-stoichiometric composition, the oxide contains so-called lattice defects and, hence, free electrons are present therein, which electrons impart electrical conductivity to the oxide layer having a thickness in the preferred 10–200 $\mu$m range. Accordingly, the electrode substrate of the invention which has such an oxide layer on the surface thereof is stable not only when used in electrolytic processes using electrolyte solutions containing fluorine or a fluorine compound and in electrolytic processes involving a reversal of current flow, but also can be used in electrolysis without causing an excessive ohmic loss due to the relatively high electrical conductivity. Thus, the substrate of the present invention is a novel electrode substrate different from any of the conventional ones.

On this electrode substrate, an electrode active material layer is formed either directly or through an intermediate layer or the like, thereby providing an electrolytic electrode. There is no particular limitation as to whether such an intermediate layer is formed or not and there is no particular limitation on the materials to be used in the intermediate layer and the electrode active material layer.

However, in order to further improve the stability to fluorine and fluorine compounds and to electrolysis involving a reversal of current flow, which stability is one of the effects brought about by the present invention, an intermediate thin layer containing at least one of titanium, tantalum, and platinum may be formed between the electrode substrate and the electrode active material layer.

When an electrode produced by forming a layer of an electrode active material directly on the electrode substrate is used in electrolysis at a high current density, there are cases in which oxygen evolved at the anode migrates through the oxide layer to the interface between the oxide layer and the electrically conductive substrate and oxidizes the surface layer of the substrate, causing an interruption in the electric current flow or causing the oxide layer to peel off. Although platinum-covered electrode substrates have conventionally been employed in order to solve the above-described problem, the platinum itself may function as an electrode because it is active as an electrode catalyst. If the platinum functions as an electrode, the results are peeling of the electrode active material layer overlying the platinum layer and a decrease of electrode life.

Therefore, in one preferred embodiment of the electrolytic electrode according to the present invention, an intermediate layer containing a mixed oxide of titanium and tantalum along with platinum is formed on the electrode substrate to thereby inhibit the catalytic activity of the platinum and to attain stronger adhesion between the intermediate thin layer and the electrode substrate. This intermediate thin layer may be formed by a conventional thermal decomposition method or other conventional method. For example, hydrochloric acid containing platinum, titanium, and tantalum may be coated on the electrode substrate described above, dried, and then calcined in air at a temperature of from 400 to 600° C. and, if necessary, this procedure may be repeated, whereby an intermediate thin layer can be formed. The thickness of the intermediate thin layer is not particularly limited.

Subsequently, the intermediate thin layer containing platinum is covered with an electrode active material layer to provide an electrolytic electrode. As the material for forming this electrode active material layer, any of conventionally employed electrode active materials such as a mixed oxide comprising iridium oxide and tantalum oxide, may be used without any particular limitation.

The electrolytic electrode thus produced is characterized in that the electrode substrate has resistance to fluorine or fluorine compounds and to electrolysis involving a reversal of current flow and also has relatively high electrical conductivity, and in that the intermediate thin layer inhibits evolved oxygen from migrating toward the electrically conductive substrate. Therefore, the oxide layer and any other layer are kept in a stabilized state and prevented from peeling off and, hence, the electrolytic electrode of the present invention enables electrolytic processes which use electrolyte solutions containing fluorine or a fluorine compound or which involve a reversal of current flow to be conducted stably over a long period of time without causing a large ohmic loss. Such an efficient electrolytic process has never been attained with any of the conventional electrodes.

The present invention will be explained below in more detail with reference to the following examples which illustrate production methods for electrode substrates and electrolytic electrodes according to the invention. However, the present invention should not be construed as being limited thereto.

EXAMPLE 1

To a rutile white powder (titanium oxide powder) for electronic use was added a tantalum oxide powder in an amount of 20% by weight based on the weight of the rutile white powder. Thereto was further added a titanium sponge powder in an amount of 5% by weight based on the weight of the rutile white powder. The mixed powder particles were thoroughly pulverized in an alcohol and then molded into a disk form using a pressing machine. This molded disk was placed in a muffle furnace and sintered at 1,300° C. for 3 hours. The resulting sintered product was pulverized and then subjected again to molding and sintering, thereby obtaining a uniform sintered product. This sintered product had an electrical conductivity of $5\times10^{-3}$ Ωcm, showing that the product was highly electrically conductive. The crystalline phase of the sintered product was mainly of the rutile type partly containing $Ta_2O_5$. This sintered product was pulverized by a wet pulverization method, to thereby prepare 345 mesh coating material particles for flame spraying.

The surface of a titanium plate was roughened by grit blasting and then activated by acid washing. The coating material particles prepared above were flame-sprayed over this titanium plate by plasma spray coating to form an oxide layer having a thickness of about 100 μm, thereby obtaining an electrode substrate.

The surface of this electrode substrate was coated with hydrochloric acid containing platinum, titanium, and tantalum in a molar ratio of 1:8:1. The coated electrode substrate was heated in air at 530° C. for 10 minutes to pyrolyze the coating, thereby forming an intermediate thin layer.

Subsequently, the surface of the intermediate thin layer was coated with hydrochloric acid containing iridium and tantalum in a molar ratio of 6:4, and the coating was heated in air at 530° C. for 10 minutes to pyrolyze the coating. This coating-pyrolysis procedure was repeated 5 times to form an electrode active material layer comprising a mixed oxide. Thus, an electrode was produced.

As a control, an electrode was prepared in the same manner as above except that the oxide layer was omitted.

The two electrodes thus obtained were subjected to an electrolysis test using an electrolyte solution prepared by adding hydrofluoric acid to 150 g/l sulfuric acid in an amount such that the resulting solution had a fluorine concentration of 100 ppm.

Electrolysis was conducted under conditions of an electrolyte solution temperature of 60° C. and a current density of 150 $A/dm^2$. As a result, even after a 3,000 hour electrolysis, the electrode according to the present invention which had an oxide layer was in a good condition such that it was able to be further used in electrolysis. In contrast, the control electrode having no oxide layer suffered peeling of the covering and became unusable after a 700 hour electrolysis.

EXAMPLE 2

An electrode was prepared in the same manner as in Example 1 except that an electrode active material layer was formed directly on the surface of the electrode substrate without forming an intermediate thin layer. Using this electrode, electrolysis was conducted under the same conditions as in Example 1. As a result, the electrolysis was able to be continued stably for 2,500 hours.

EXAMPLE 3

The surface of a stainless-steel (SUS0316) plate was roughened by grit blasting to a roughness $R_{MAX}$ of about 100 $\mu$m. This stainless-steel plate was subjected to cathodic polarization treatment in Glauber's salt and then baked in air at 700° C. to form an oxide layer on the surface of the plate.

The oxide layer surface was then coated with a butyl alcohol solution containing iron nitrate, titanium tetrachloride, and tantalum pentachloride in a molar ratio of 1:8:1, and the coating was dried and then calcined at 550° C. for 10 minutes. This procedure was repeated 4 times to form a binder layer. Examination of the state of this binder layer by X-ray diffractometry revealed that the layer had a rutile-type crystalline phase mainly composed of titanium oxide. This oxide layer had an electrical conductivity of about $10^{-2}$ Ωcm.

The same coating material particles as used in Example 1 were flame-sprayed over the surface of the binder layer by plasma spray coating to form an oxide layer having a thickness of 150 $\mu$m, thereby providing an electrode substrate.

An electrode active material layer comprising a mixed oxide of iridium and tantalum was then formed on the electrode substrate in the same manner as in Example 1 except that the active material layer was formed directly on the electrode substrate without forming an intermediate thin layer. Thus, an electrode was produced.

As in Example 1, electrolysis was conducted using the thus-obtained electrode and using the same electrolyte solution, i.e., fluorine-containing 150 g/l sulfuric acid, under conditions of an electrolyte solution temperature of 60° C. and a current density of 150 A/dm$^2$. As a result, the electrode did not undergo any change in 500 hours of electrolysis.

EXAMPLE 4

An electrode was prepared in the same manner as in Example 3 except that the oxide layer was formed directly on the same stainless-steel plate which had undergone cathodic polarization treatment and baking in air, without forming a binder layer.

Using this electrode, electrolysis was conducted under the same conditions as in Example 3. As a result, the electrolysis was able to be continued for 100 hours or more. For comparison, a control electrode was prepared in the same manner as above except that the oxide layer was omitted, and electrolysis was conducted likewise using this control electrode. As a result, the control electrode suffered peeling of the covering and became unusable immediately after the initiation of the electrolysis.

EXAMPLE 5

The surface of a 3 mm thick titanium plate of a commercial grade was roughened by steel grit blasting to a roughness $R_{MAX}$ of about 100 $\mu$m. This titanium plate was immersed for about 2 hours in 25% hydrochloric acid having a temperature of 60° C. After the blasting grits remaining on the surface of the titanium plate had dissolved away, the resulting titanium plate was immersed for 3 hours in 25% sulfuric acid having a temperature of 85° C. to activate the surface of the plate, thereby providing an electrically conductive substrate. The surface of this substrate was coated with dilute hydrochloric acid containing a chloride of titanium and a chloride of niobium (9:1 by mol), and the coating was dried and then calcined in an air flow at 450° C. for 10 minutes. This procedure was repeated 4 times to form a binder layer, upon which the substrate assumed a pale blue color. This color change was probably attributable to formation of an oxide covering on the surface.

Separately, a coating material powder was prepared by mixing a rutile powder of an electronic grade with a 9:1 by molar ratio mixture of tantalum oxide and niobium oxide in an amount of 10% by weight based on the weight of the rutile powder and pulverizing the mixed powder particles into a 350 mesh powder. This coating material powder was flame-sprayed over the surface of the binder layer by a conventional flame spray coating method to form an oxide layer having a thickness of about 100 $\mu$m, thereby providing an electrode substrate. The crystalline state of this oxide layer was examined by X-ray diffractometry. As a result, the oxide constituting the oxide layer was found to have a rutile-type phase with a slightly widened diffraction line, and two or three weak diffraction lines were observed which were unassignable. It was concluded from these results that the oxide constituting the oxide layer had a non-stoichiometric composition having oxygen defects. This oxide layer was extremely adhesive, was stable, and had sufficient electrical conductivity.

The surface of the thus-obtained electrode substrate was coated with hydrochloric acid containing titanium, tantalum, and platinum in a molar ratio of 25:25:25, and the coating was dried in air and then calcined, with air feeding, in a muffle furnace at 530° C. for 15 minutes. This procedure was repeated twice to form an intermediate thin layer. This thin layer had a platinum content of 0.5 g/m$^2$. The surface of the thus-formed intermediate thin layer was coated with hydrochloric acid containing iridium and tantalum in a molar ratio of 70:30, and the coating was dried and calcined. This procedure was repeated to form an electrode active material layer. Thus, an electrode was produced.

On the other hand, a control electrode was prepared in the same manner as above except that the oxide layer formed by flame spraying was omitted.

Using the two electrodes thus obtained, electrolysis was conducted in an electrolyte solution prepared by adding 1% by weight of hydrofluoric acid to 200 g/l sulfuric acid, under conditions of an electrolyte solution temperature of 60° C. and a current density of 150 A/dm$^2$.

As a result, even after 3,000 hours electrolysis, the electrode according to the present invention was in a good state such that it was able to be further used in electrolysis. In contrast, 95 hours after initiation of the electrolysis, the control electrode having no oxide layer suffered peeling of the covering and the electrically conductive titanium substrate had suffered a corrosion which probably was pitting.

EXAMPLE 6

Using an electrode sample prepared in the same manner as in Example 5, electrolysis was conducted in 150 g/l sulfuric acid as the electrolyte solution.

This electrolysis was performed cyclically, with each cycle being made up of two stages using different polarities. In the first stage which continued for 10 minutes, an electric current was applied so as to flow in the normal direction at a current density of 150 A/dm$^2$, while in the second stage which continued for 3 minutes, an electric current was applied so as to flow in the reverse direction at a current density of 15 A/dm$^2$.

As a result, no abnormality was observed on the electrode even after b 3,000hours of electrolysis.

In contrast, a control electrode which was the same as above except that it had no oxide layer (flame spraying-formed layer) suffered peeling of the covering and became unusable after 300 hours of electrolysis.

As described above, the electrode substrate according to the present invention is characterized in that an oxide layer having a thickness of from 10 to 200 $\mu$m and a non-stoichiometric composition containing oxygen and at least one of titanium, tantalum, and niobium has been formed on the electrically conductive substrate directly or through a binder layer.

This oxide layer has resistance characteristics similar to those of ceramics and is resistant to fluorine or fluorine compounds and to electrolysis involving a reversal of current flow. Further, since the oxide layer has a non-stoichiometric composition, i.e., a crystalline structure having lattice defects and, hence, containing free electrons, it shows relatively high electrical conductivity. Therefore, the electrode substrate of the present invention can be of a high-resistance and low-power-consumption type which has never been provided by prior art techniques. These advantages are due to the substrate's relatively high electrical conductivity and to its freedom from the ceramics' defect of large ohmic loss, and are further due to the fact that the substrate has resistance characteristics similar to ceramics. The reasons for the preferred upper limit of 200 $\mu$m for the thickness of the oxide layer are that too large thicknesses of the oxide layer not only result in increased ohmic losses but also cause the oxide layer to be apt to peel off.

Where the adhesion between the electrically conductive substrate and the oxide layer in the electrode substrate is weak, a binder layer may be formed between the two layers, i.e., on the electrically conductive substrate, to thereby prevent the oxide layer from peeling off or suffering undesirable changes. Because the purpose of this binder layer is to improve the adhesion of the oxide layer to the electrically conductive substrate, the binder layer is preferably constituted of a mixed oxide of at least one of the metals contained in or constituting the electrically conductive substrate and at least one of the metals to be contained in the oxide layer. An electrode substrate made with such a binder layer has further improved resistance characteristics and enables electrolytic electrodes using this substrate to be used stably over a longer period of time.

Covering the electrode substrate with an electrode active material provides an electrolytic electrode. However, there are cases in which, when the thus-obtained electrode is used in electrolysis, oxygen evolved by the electrolysis migrates through the oxide layer and reaches the interface between the oxide layer and the electrically conductive substrate, causing the oxide layer to peel off the electrically conductive substrate. It has conventionally been known that the migration of oxygen can be inhibited by interposing platinum between the electrode active material layer and the electrode substrate. However, since platinum itself has electrode activity, a gas is evolved on the surface of the interposed platinum and this may result in peeling of the electrode active material layer. According to the present invention, in order to inhibit this adverse effect of platinum, an intermediate thin layer comprising titanium oxide, tantalum oxide, and platinum is interposed between the oxide layer and the electrode active material layer. Due to the presence of titanium oxide and tantalum oxide, the electrode activity of the platinum is inhibited sufficiently while allowing the intermediate thin layer to retain the oxygen-barrier ability of the platinum, thereby attaining a lengthened electrode life.

In producing the electrode substrate or electrode described above, it is desirable that the oxide layer be formed by flame-spraying coating material particles by means of plasma spray coating or the like. This is because flame spraying ensures formation of an oxide layer having a non-stoichiometric composition and, hence, enables production of an electrode substrate having both good resistance characteristics and sufficient electrical conductivity or production of an electrode using such substrate.

In producing an electrolytic electrode having an intermediate thin layer by the process of the present invention, the intermediate thin layer is formed by a thermal decomposition method. By this process, an electrode can be easily produced in which the intermediate thin layer containing titanium oxide, tantalum oxide, and platinum can protect the electrode substrate from evolved oxygen.

While the invention has been described in detail and with reference to specific embodiments thereof, it will be apparent to one skilled in the art that various changes and modifications can be made therein without departing from the spirit and scope thereof.

What is claimed is:

1. A process for producing an electrolytic electrode, comprising the steps of:

flame-spraying particles of at least one oxide selected from the group consisting of titanium oxide, tantalum oxide, and niobium oxide over a surface of an electrically conductive substrate to form an oxide layer on said electrically conductive substrate, said oxide layer comprising a mixed oxide having a non-stoichiometric composition and having a thickness of from 10 to 200 $\mu$m, to thereby provide an oxide coated electrode substrate;

forming an intermediate thin layer containing titanium oxide, tantalum oxide, and platinum on the oxide coated electrode substrate by thermal decomposition; and forming an electrode active material layer on the intermediate thin layer.

2. The process of claim 1, wherein the oxide layer has a thickness of 50 to 100 $\mu$m.

3. The process of claim 1, wherein the oxide layer has an electrical resistivity of $10^{-2}$ to $10^{-3}$ $\Omega$cm.

* * * * *